United States Patent [19]

Tsukamoto et al.

[11] Patent Number: 4,829,309

[45] Date of Patent: May 9, 1989

[54] PLANAR ANTENNA

[75] Inventors: Katsuya Tsukamoto; Yasuhiro Fujii; Yasumasa Ogawa; Sadaaki Kondo; Kyoji Masamoto; Masakatsu Niwa; Masayuki Matsuo; Yoshihiro Kitsuda; Hajime Takeda; Shoji Miyanari; Hiroshi Yokota; Shuji Taniguchi, all of Kadoma, Japan

[73] Assignee: Matsushita Electric Works, Ltd., Osaka, Japan

[21] Appl. No.: 81,440

[22] Filed: Aug. 4, 1987

[30] Foreign Application Priority Data

| | | | |
|---|---|---|---|
| Aug. 14, 1986 | [JP] | Japan | 61-191134 |
| Oct. 1, 1986 | [JP] | Japan | 61-233787 |
| Apr. 15, 1987 | [JP] | Japan | 62-92443 |
| Apr. 24, 1987 | [JP] | Japan | 62-102540 |

[51] Int. Cl.[4] ..... H01Q 1/38

[52] U.S. Cl. ..... 343/700 MS; 343/830; 343/846

[58] Field of Search ..... 343/700 MS, 829, 830, 343/846, 872, 795, 786

[56] References Cited

U.S. PATENT DOCUMENTS

| | | | |
|---|---|---|---|
| 3,665,480 | 5/1972 | Fassett | 343/700 MS |
| 3,718,935 | 2/1973 | Ranghelli et al. | 343/846 |
| 3,747,114 | 7/1973 | Shyhalla | 343/795 |
| 4,475,107 | 10/1984 | Makimoto et al. | 343/700 MS |
| 4,477,813 | 10/1984 | Weiss | 343/700 MS |
| 4,527,165 | 7/1985 | de Ronde | 343/786 |
| 4,633,262 | 12/1986 | Traut | 343/700 MS |

FOREIGN PATENT DOCUMENTS

| | | | |
|---|---|---|---|
| 66206 | 4/1984 | Japan | 343/700 MS |
| 2131232 | 6/1984 | United Kingdom | 343/700 MS |

*Primary Examiner*—William L. Sikes
*Assistant Examiner*—Michael C. Wimer
*Attorney, Agent, or Firm*—Burns, Doane, Swecker & Mathis

[57] ABSTRACT

A plane antenna comprises a power-supply circuit, a radiator circuit and an earthing conductor which are stacked respectively with a dielectric layer interposed between them, in which the power-supply and radiator circuits are made independent of each other as electromagnetically coupled to each other and at least one of the dielectric layers is formed with a foamed resin, whereby insertion loss can be reduced to remarkably improve the antenna characteristics. Only with the interposition of the foamed resin dielectric layer or layers, an effective separation is achieved between at least the power-supply circuit and the earthing conductor or the power-supply circuit and the radiator circuit, for a large extent improvement in the assembling ability.

12 Claims, 6 Drawing Sheets

PLANAR ANTENNA

TECHNICAL BACKGROUND OF INVENTION

This invention relates to plane antennas and, more particularly, to a plane antenna preferably of a tri-plate structure, which can provide a high gain and excellent antenna characteristics.

The plane antennas of the kind referred to are effectively utilized in receiving circularly polarized waves and the like which are transmitted as carried on SHF band, in particular, 12 GHz band from a geostationary broadcasting satellite launched into cosmic space to be 36,000 Km high from the earth.

DISCLOSURE OF PRIOR ART

While parabolic antennas erected on the roof or the like position of house buildings have been generally utilized as antennas for receiving such microwaves as circularly polarized waves from the geostationary broadcasting satellite, the parabolic antennas have been defective in that they are susceptible to being blown over by a strong wind due to their bulky structure so that means for stably supporting them will have to be additionally employed.

In attempt to eliminate these problems of the parabolic antennas, there has been suggested in Japanese Patent Application Laid-Open Publication No. 99803/1982 (corresponding to U.S. Pat. No. 4,475,107 or German Offenlegungsschrift No. 314900.2) a plane antenna which is flattened in the entire configuration, according to which the structure can be much simplified and can be directly mounted on an outdoor wall or the like position of buildings so as to be made inexpensive.

On the other hand, the plane antenna is required to be of a high gain, for which purpose various attempts have been made to reduce insertion loss. Disclosed in, for example, U.S. Pat. No. 4,477,813 by Michael A. Weiss is a plane antenna in which a first dielectric substrate having thereon a power-supply line circuit is fixedly mounted on a ground conductor, a second dielectric substrate having thereon a radiator circuit is arranged as separated from the first dielectric substrate to form a space between the substrates, and a honeycomb-shape dielectric is provided between the two dielectric substrates. This plane antenna is intended to reduce the insertion loss in contrast to any known antenna arrangement having the radiator and power-supply line circuits directly embedded in a dielectric layer, by disposing the radiator circuit within the space.

This arrangement of Weiss, however, has had such a problem that the power-supply line circuit is provided not in the space but rather directly on the second dielectric substrate disposed on the earthing conductor, so that the insertion loss in a zone of the power-supply line circuit is still large to give an affection to the function of the radiator circuit zone, which results in that the overall insertion loss of the antenna cannot be reduced to a satisfactory level.

According to another U.S. patent application Ser. No. 15,009 of K. Tsukamoto et al (to which U.K. Patent Application No. 87 03640, German Patent Application No. P 37 06 051.1 or French Patent Application No. 87 02421 corresponds), there has been suggested a plane antenna in which the power-supply circuit and radiator circuit are both coated on their surface with a synthetic resin and the both circuits as well as the ground conductor are respectively separated from one another through a space retaining means for operating them with a magnetic coupling.

In this plane antenna, the power supply circuit also can be disposed in the space thus retained so as to minimize the insertion loss, whereby the conventional problems involved in the plane antennas can be eliminated and thus the high gain can be attained. However, problems are still left unsolved in that a high precision is required in manufacturing and assembling component parts for spacing the both circuits and ground conductor through the space retaining means, and so on. In an event where a paper-made honeycomb is merely employed as the space retaining means, there arises such a problem that the insertion loss is increased due to the moisture absorbed by such paper honeycomb, so as to lower the antenna characteristics.

TECHNICAL FIELD OF INVENTION

It is an object of the present invention, therefore, to provide a plane antenna wherein the power-supply and radiator circuits as well as the ground conductor are respectively effectively spaced from one another with an interposition of a simpler and effective dielectric layer, to reduce the insertion loss and remarkably improve the antenna characteristics.

According to the present invention, this object is attained by providing a plane antenna in which a power-supply circuit and a radiator circuit which are of an electrically conductive material as well as a ground conductor are disposed respectively with an interposition of a dielectric layer to render the power-supply and radiator circuits to be independent of each other but electromagnetically coupled to each other, forming thus an antenna surface for receiving the circularly polarized waves and the like transmitted as carried on SHF band, wherein at least one of the dielectric layers disposed between the power-supply and radiator circuits and the ground conductor comprises a foamed resin.

Other objects and advantages of the present invention shall be made clear in the following disclosure of the invention detailed with reference to respective embodiments shown in accompanying drawings.

While the invention shall now be explained with reference to the embodiments shown in the accompanying drawings, it should be appreciated that the intention is not to limit the invention only to such embodiments but is to include all alterations, modifications and equivalent arrangement possible within the scope of appended claims.

DISCLOSURE OF PREFERRED EMBODIMENTS

Figure 1:
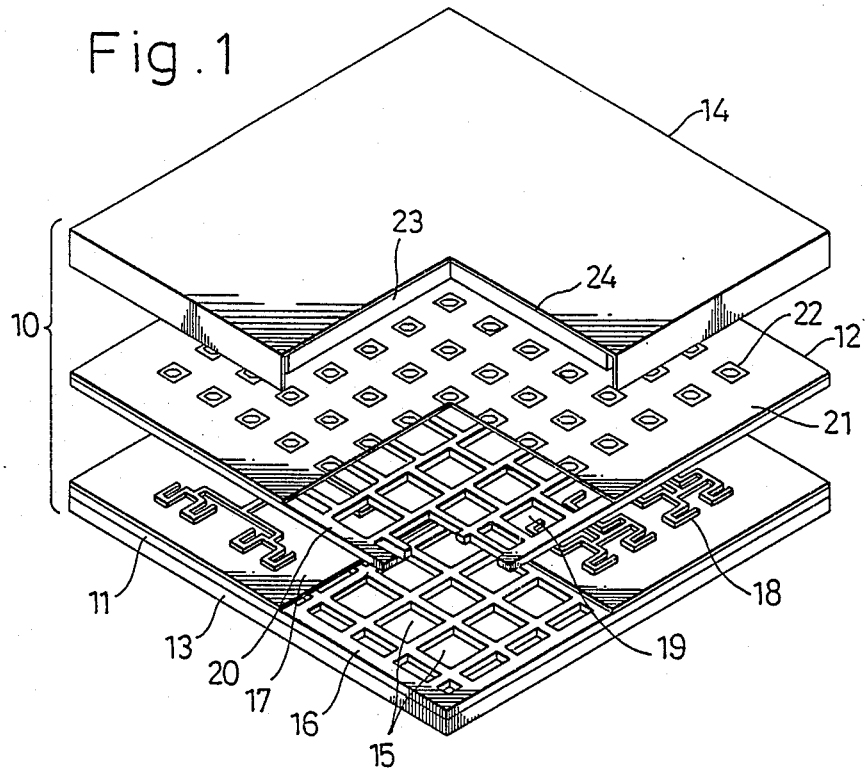
FIG. 1 is a perspective view of a main part of the plane antenna according to the present invention in a first embodiment thereof, with respective members shown partly cut off and disassembled.
Figure 2:
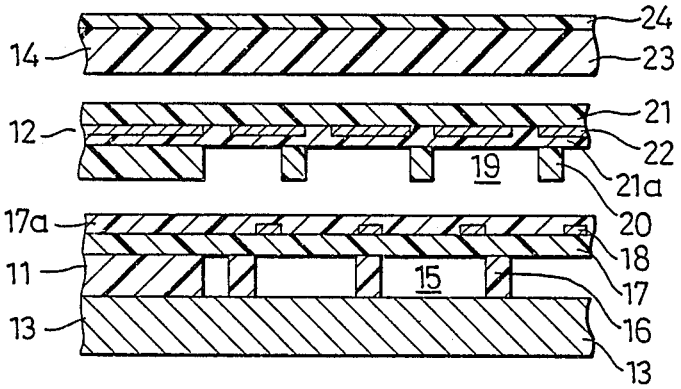
FIG. 2 is a fragmentary vertically sectioned view also as disassembled of the plane antenna of FIG. 1.
Figure 3:
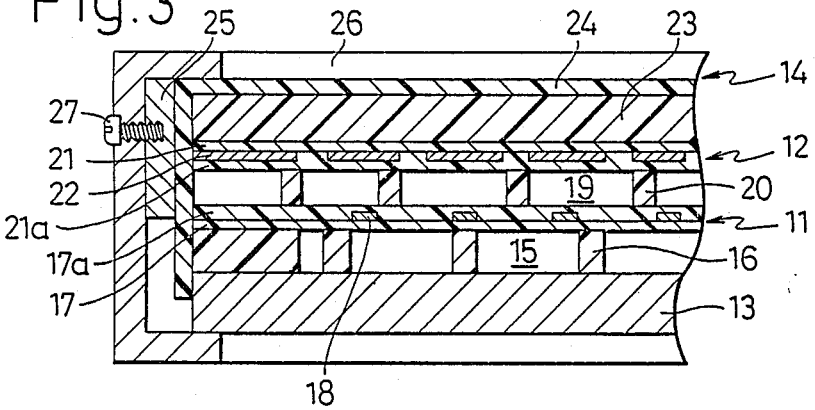
FIG. 3 is a fragmentary sectioned view as assembled of the plane antenna of FIG. 1.

Referring here to FIGS. 1 to 3, a plane antenna body 10 according to the present invention generally comprises a first antenna layer 11, a second antenna layer 12, an ground conductor 13 and, if required, such a protective member 14 as a radome. More specifically, the first antenna layer 11 comprises a first dielectric layer 16 preferably of a foamed resin in a lattice formation defining therein many square cavities 15, first sheet member 17 containing an elastic synthetic resin material and a power-supply circuit 18 formed of a conductive material such as copper, aluminum, silver, astatine, iron, gold or the like, while the power-supply circuit 18 is preferably covered by a coating layer 17*a* and the first dielectric layer 16 is directly brought into contact with the ground conductor 13 of such metallic material as aluminum or the like. The second antenna layer 12 comprises a second dielectric layer 20 preferably of a foamed resin in a lattice formation also defining therein many square cavities 19, second sheet member 21 of an elastic synthetic resin material and a radiator circuit 22 of the same material as the power-supply circuit 18 and provided on the second sheet member 21, while the radiator circuit 22 is also preferably covered by a synthetic resin layer 21*a*. The protective member 14 is provided to be fitted over the second dielectric layer 12, and is formed of a core layer 23 of a synthetic resin material and a foamed-resin layer 24 of a foam resin. In the present instance, the foamed-resin layer 24 is configured to be of a shallow box shape opened downward, so that peripheral walls of this box-shaped layer 24 will intimately abut peripheral edges of the ground conductor 13. In other words, the ground conductor 13 and foamed-resin layer 24 are configured to cooperate with each other so that the ground conductor 13 will constitute a body or bottom of a shallow box-shaped casing while the foamed-resin layer 24 will constitute a covering lid of the casing, and the first and second antenna layers 11 and 12 will be tightly intimately housed within the casing.

For the first and second dielectric layers 16 and 20, a dielectric material exhibiting a specific inductive capacity $\epsilon\lambda$ below 1.3 is employed, and these layers are so designed that, at positions where the power-supply circuit 18 intersects the lattice-shaped dielectric layer 16, the characteristic impedance of the circuit 18 will not be caused to vary but any reflection loss of the microwaves will be a minimum. So long as the specific inductivity of the dielectric layers 16 and 20 is kept below the value 1.3, various types of the foam resin can be employed, such as a foam polyethylene or polystyrene of a foaming rate of more than 5 times or a foam polyurethane of polybutadiene of a foaming rate of more than 10 times. The square cavities 15 and 19 in the first and second dielectric layers 16 and 20 are so dimensioned as to be able to support the power-supply circuit 18 or radiator circuit 22 at a uniform interval, and are made to have an edge length of 5 to 60 mm. The size of these cavities 15 and 19 is properly set in dependency on the thickness of the first and second sheet members 17 and 21, in such that, when both sheet members 17 and 21 are of polyester of 10 μm thick, the cavity edge length may be less than 50 μm while the length may be smaller as the thickness of the sheet members is made smaller. For the material of the first and second sheet members 17 and 21, it may be selected from various ones which are 20 to 150 μm thick, but the one exceeding 150 μm thick renders the dielectric lsos to be large. The cavities are not always required to the square so long as the space factor of the cavities of the dielectric layers 16 and 20 with respect to the surface area of the layers is more than 4/9, and they can be of circular, triangular or any other polygonal shape. Further, it should be appreciated that, even where one of the dielectric layers 16 and 20 is made to be an air layer in the above arrangement while the other is kept to be of the foamed resin, the assembling ability may be assured to some extent.

Figure 4:
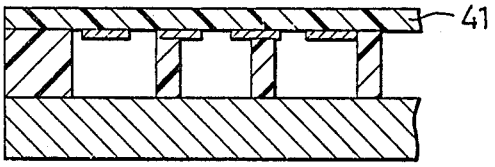
FIG. 4 is a schematic fragmentary sectioned view as assembled of a plane antenna in another embodiment according to the present invention.
Figure 5A:
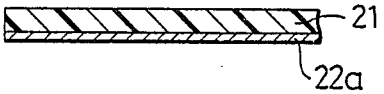
FIGS. 5(*a*) to 5(*e*) are explanatory views of assembling sequence of the plane antenna of FIG. 1.
Figure 5B:
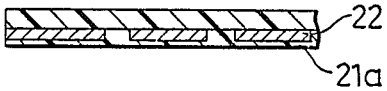
Figure 5C:
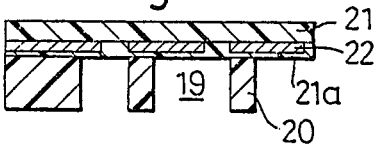
Figure 5D:
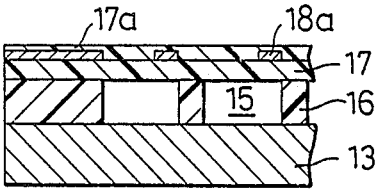
Figure 5E:
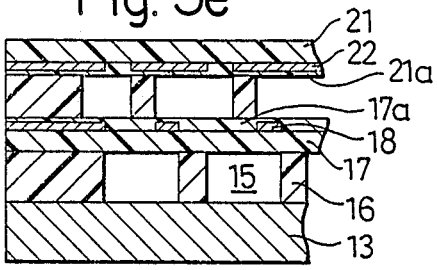

While it is preferable to adopt the tri-plate structure such as in the embodiment of FIGS. 1–3, it is of course possible to employ, if required, a dual-plate structure as shown in FIG. 4, wherein the power-supply and radiator circuits will be disposed to co-exist on a surface of the second sheet member 41.

An example of manufacturing steps for the plane antenna of FIGS. 1–3 shall be referred to next, with reference to FIGS. 5(*a*) to 5(*e*). As shown in FIG. 5(*a*), a conductive member 22*a* formed of a foil is bonded to the second sheet member 21 by means of a dry lamination, extrusion lamination or the like, the conductive member 22*a* is subjected to an application of a resist ink in a desired circuit pattern and then to an etching process of forming the circuit pattern, a covering layer 21*a* is provided thereover, and the radiator circuit 22 is thus formed as shown in FIG. 5(*b*). The second dielectric layer 20 is laminated next, as shown in FIG. (*c*), the layer 20 is provisionally secured if required onto the circuit by means of an adhesive agent, and the second antenna layer 12 is thereby formed. On the other hand, the first antenna layer 11 is also formed in the same manner as the second antenna layer 12, by bonding a foil-shaped conductive member 18*a* onto the first sheet member 17, applying the resist ink, carrying out the etching process, and by providing a covering layer 17*a*, whereby the power-supply circuit 18 is thus formed.

This circuit 18 is then stacked on the ground conductor 13 with the first dielectric layer 16 interposed between them, as provisionally secured as required to the conductor by means of an adhesive agent, as shown in FIG. 5(*d*).

In the foregoing manufacturing steps, if required, the first dielectric layer 16 of the foamed resin and the first sheet member 17 of synthetic resin material may be bonded to each other. In an event where, for example, the material of the first sheet member 17 is of a nonpolar type, i.e., wherein no charge is concentrated in molecular scale, such as polystyrene and polyethylene, so that the dielectric loss is small. However, the first dielectric layer 16 or the first sheet member 17 is subjected at its surface to a corona discharge treatment or the like, and an adhesive agent is applied thereto. Whether the adhesive agent is to be applied to the first dielectric layer 16 or to the first sheet member 17 is to be determined depending on the solvent resistance of the foam resin material employed for the dielectric layer. When the foamed resin layer is of, for example, such a resin material low in the solvent resistance as foamed polystyrene, it is then preferable to apply the adhesive agent to the first sheet member 17. For the bonding, any of roll lamination, press lamination and dry lamination may be employed.

As shown in FIG. 5(*e*) next, the first and second antenna layers 11 and 12 are stacked on the ground conductor 13, and the protective member 14 is provided over the second antenna layer 12 to form the plane antenna body 10.

Since the plane antenna body 10 of the present invention takes the foregoing structure, its assembly may be achieved simply by stacking sequentially the first and second antenna layers 11 and 12 on the ground conductor 13 which forms the bottom of the casing, and fitting thereover the protective member 14 which forms the covering lid of the casing, so that the plane antenna body 10 can be provided without requiring any separately prepared casing, while intimately accommodating the first and second antenna layers 11 and 12 between the ground conductor 13 and the protective member 14. The plane antenna body 10 is completed, as shown in FIG. 3, by peripherally tightly enclosing the thus achieved assembly with a square-shaped frame 25, and securing thereabout a holding frame 26 by means of screws 27 fastened therethrough to the frame 25, the holding frame 26 comprising, for example, four divisions substantially U-shaped in section for matching to the thickness of the body 10 and joined to one another at respective corners of the body 10.

The plane antenna of the present invention has been prepared in accordance with the foregoing manufacturing steps, as in the following Examples, and its antenna characteristics have been measured for comparing with a Comparative Example.

EXAMPLE 1

Polyester film of a thickness of 100 μm was employed for the first and second sheet members 17 and 21, a copper foil of a thickness of 35 μm was employed for the conductive members 18*a* and 22*a* and bonded to the polyester film by means of the dry lamination, predetermined patterns of the power-supply and radiator circuits 18 and 22 were printed on the copper foils with a resist ink by means of a screen printing, the etching process was performed with respect to them and the resist ink was removed. A sheet of polystyrene foamed at foaming rate of 10 times into a lattice formation including the continuous cavities 15 of an edge length of 20 mm was employed as the first dielectric layer 16, the first sheet member 17 having on a surface the power-supply circuit 18 was bonded onto the layer 16, and they were stacked on the ground conductor 13 of an aluminum sheet. The second dielectric layer 20 was prepared with a similar foamed polystyrene sheet, and the second sheet member 21 having on one surface the radiator circuit 22 was bonded onto the layer 20. Power supply terminals were mounted on the power-supply circuit 18, the second antenna layer 12 was stacked on the first antenna layer 11, the radiator circuit 22 was electrically connected to the ground conductor 13, and the plane antenna body 10 was obtained.

EXAMPLE 2

Another plane antenna body 10 was obtained through the same steps as in the above EXAMPLE 1 except that the cavities in the first and second dielectric layers 16 and 20 were made to be of an edge length of 50 mm.

EXAMPLE 3

A further plane antenna body 10 was obtained through the same steps as in the above EXAMPLE 1 except the cavities in the first and second dielectric layers 16 and 20 were made to be circular with a diameter of 30 mm.

EXAMPLE 4

A copper foil of 50 μm thick was bonded onto a sheet member of 50 μm thick, patterns corresponding to the power-supply and radiator circuits 18 and 22 were printed with a resist ink on the foils by means a gravure printing, the circuits were obtained through the etching process, they were stacked, without removing the resist ink, together with the dielectric layers of polyethylene of the foaming rate of 5 times and the ground conductor 13 of an aluminum plane 2 mm thick, and a plane antenna in such form as shown in FIG. 3 was obtained.

COMPARATIVE EXAMPLE

A plane antenna was obtained substantially through the same steps as in the foregoing EXAMPLE 1, except that the first and second dielectric layers were formed by a polyethylene plate of 2 mm thick and subjected to the corona discharge treatment and to an application of the same adhesive agent at a rate of 3 g/m$^2$.

Measurements of the antenna gain and power-supply line loss were made with respect to the respective plane antenna bodies obtained through these EXAMPLES 1 to 4 and COMPARATIVE EXAMPLE, results of which have been as in following TABLE I, and it has been made clear that the plane antenna employing the dielectric layers having the cavities according to the present invention has been remarkably improved in the antenna characteristics.

TABLE I

| | Antenna Gain (dB) | Power-Supply Line Loss (dB/m) |
|---|---|---|
| EXAMPLE 1 | 33.5 | 1.1 |
| EXAMPLE 2 | 33.0 | 1.3 |
| EXAMPLE 3 | 33.2 | 1.2 |
| EXAMPLE 4 | 31.5 | 1.1 |
| COMP. EXAMPLE | 30.3 | 2.9 |

Further measurements of antenna bands (1 dB/m down) have been made with respect to a plane antenna obtained through the same manufacturing steps as in the foregoing EXAMPLE 1 but with the size of the cavities in the first and second dielectric layers 16 and 20 made to be 10 mm, another plane antenna likewise obtained but with the cavity size made 25 mm, still another plane antenna likewise obtained but without any cavity in the both dielectric layers, i.e., with solid dielectric layers of the foamed resin, and a further plane antenna obtained substantially through the same steps as in the foregoing EXAMPLE 1 but with the both dielectric layers not of the foamed resin, and the results have been as shown in a following TABLE II, in view of which it has been found that the plane antennas with the cavities of the size of 25 mm and without any cavity at all in the dielectric layers would be utilizable, while the plane antenna provided with the cavities of 10 mm should be satisfactory in the antenna band and also in view of advantages in the manufacture or in the supporting function of the layers.

TABLE II

| Type of Dielectric layers | Antenna Band |
|---|---|
| With cavities of 10 mm | 700 MHz |
| With cavities of 25 mm | 800 MHz |
| Without any cavity | 400 MHz |
| Not of foamed resin | 900 MHz |

Figure 6:
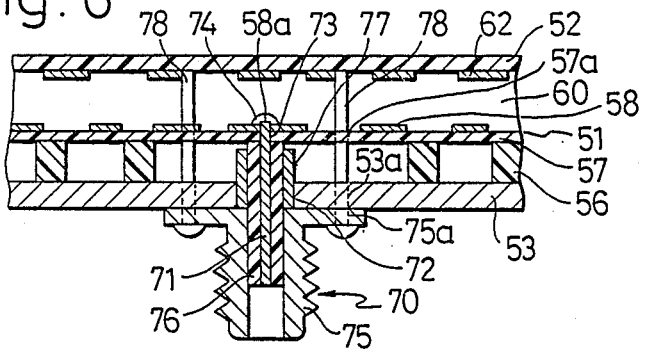
FIG. 6 is a fragmentary sectioned view as magnified of a power-supply means employable in the plane antenna according to the present invention.

According to another feature of the present invention, the plane antenna body is provided with a power-supply means which decreases the transmission loss to which the transmitting power and reflection loss are determinative. Referring to FIG. 6, a first antenna layer 51 is disposed between a second antenna layer 52 and a grounding conductor 53. A first dielectric layer 56 of foamed resin having many cavities is disposed between the first antenna layer 51 and the grounding conductor 53, whereas a second dielectric layer 60 is formed as an air layer between the first and second antenna layers 51 and 52. In this case, the second dielectric layer 60 may be formed in the form of the foamed resin layer having the many cavities, while the first dielectric layer 56 is made as the air layer.

Figure 7:
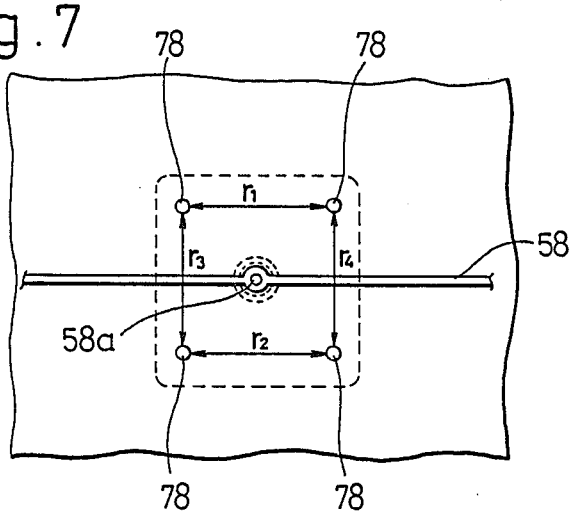
FIG. 7 is a fragmentary plan view of the power-supply means of FIG. 6.
Figure 8:
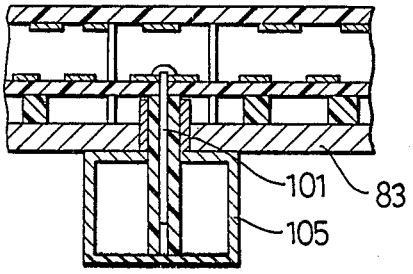
FIG. 8 is a fragmentary sectioned view of a power-supply means in other working aspect of the invention.

The first antenna layer 51 comprises a power-supply circuit 58, to which a power-supply means 70 is mounted. This power-supply means 70 comprises a power-supply pin 71 which is passed through a hole 72 of a larger diameter than the pin 71 in the ground conductor 53 and through a hole 73 of a diameter substantially equal to the pin 71 in the sheet member 57 of the first antenna layer 51 and is connected at a terminal end to a power supply point 58*a* of the power-supply circuit 58 by means of a soldering 74. The pin 71 is connected to a coaxial cable through a connector 75 aligned with a core wire of the connector 75, preferably as enclosed by a tubular dielectric member 76. A metallic sleeve 77 is fitted about the pin 71 and engaged in the hole 72 of the ground conductor 53 to be connected therewith at an end, and a plurality of electrically conductive bar members 78 are erected around the sleeve 77. Optimumly, the conductive bar members 78 are prepared in the form of screws so as to be passed through threaded holes 53*a* and 75*a* made in the ground conductor 53 and connector 75, further through holes 57*a* in the sheet member 57 of the first antenna layer 51 and finally through the second dielectric layer 60, to reach an inner surface of the second antenna layer 52. In the present instance of FIG. 6, four of the conductive bar members 78 preferably made of Teflon are provided to extend through the thickness of the plane antenna, passing through the first and second dielectric layers 56 and 60 respectively at corners of a square shape as seen in FIG. 7 which surrounding the power-supply point 58*a*, so that the distances $r_1$ to $r_4$ between the respective four members 78 will be substantially less than ½ of a wave length $\lambda_s$ of the surface wave generated adjacent the power-supply point 58*a*.

Figure 9A:
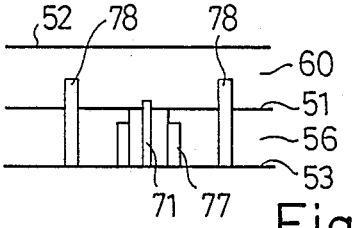
FIGS. 9(*a*) to (*c*) are schematic explanatory views of a power-supply means in another embodiment of the present invention.
Figure 9B:
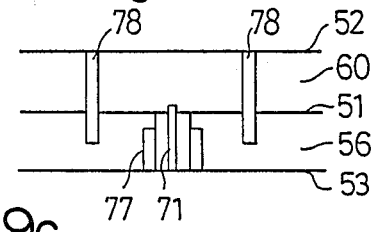
Figure 9C:
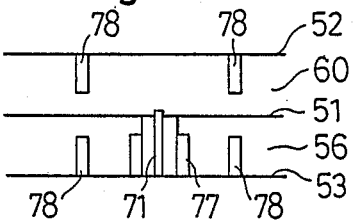

While the foregoing power-supply means has been referred to as being connected to the coaxial cable, it is possible to mount to the ground connector 83 a wave guide 105 in place of the connector and to connect a power-supply pin 101 to the wave guide 105. Instead of having the four conductive bar members 78 passed substantially through both of the first and second dielectric layers as in the above, it is possible to provide these bar members so that, as schematically shown in FIGS. 9(*a*) and (*b*), the conductive bar members 78 will pass completely through only one of the first and second dielectric layers 56 and 60 but half way through the other dielectric layer. As shown also in FIG. (*c*), alternatively, the conductive members 78 may only extend from the ground conductor 53 and second antenna layer 52 to intermediate position in both of the first and second dielectric layers 56 and 60. In all events, it is essential that more than three of the conductive bar members 78 are disposed as connected to at least one of the ground conductor 53 and second antenna layer 52 to exist in both of the first and second dielectric layers 56 and 60, and that the distance between the respective bar members is substantially less than ½ of the wave length $\lambda_s$ of the surface wave generated adjacent the power-supply point 58*a* while the power-supply pin 71 is positioned within an area defined by connecting lines between the respective conductive bar members 78. It is of course possible that the conductive bar members 78 may not be of the screw type but simply be provided in the bar shape which is secured through any proper bonding or joining means to at least one of the connector 75, wave guide 105, first and second antenna layers 51 and 52 and ground conductor 53.

Figure 10A:
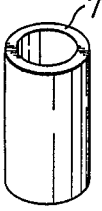
FIGS. 10(*a*) to (*c*) respectively show in a perspective view a conductive member for enclosing power-supply pin in the power-supply means.
Figure 10B:
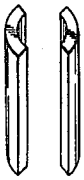
Figure 10C:
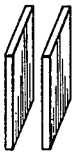
Figure 11A:
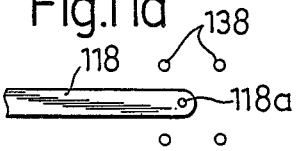
FIGS. 11(*a*) and 11(*b*) are schematic views showing terminal power-supply means employed in the present invention.
Figure 11B:
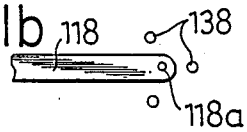

The sleeve 77 shown in FIG. 6 is such tubular shape as shown in FIG. 10(*a*) but may be replaced by such a pair of arcuate or flat shaped metallic plates as shown in FIGS. 10(*b*) and (*c*). When the power supply is intended to be achieved not from such central area as referred to of the power-supply circuit 58 in the first antenna layer 51, but from an end part of the circuit, this may be realized by connecting the power-supply pin 71 to a power-supply point 118*a* at a terminal end of the power-supply circuit 58, and providing three or four of the conductive bar members 138 to enclose the pin, as shown in FIG. 11(*a*) or (*b*).

Figure 12:
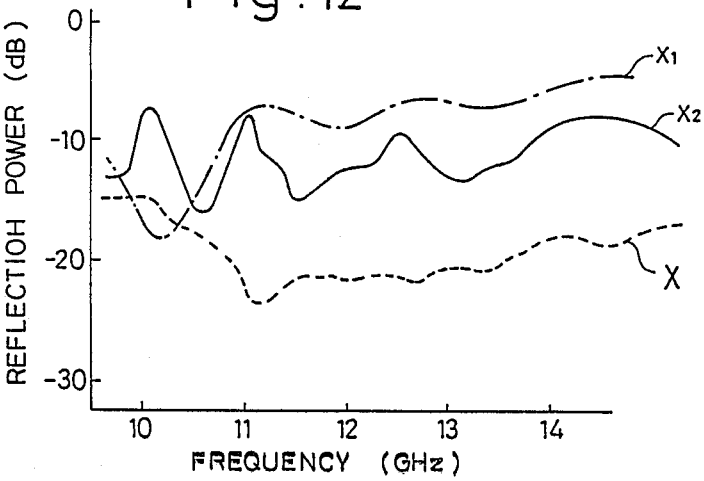
FIG. 12 is a diagram showing reflection power characteristics or various power-supply means including one employed in the present invention.

With the disposition in the foregoing power-supply means of the metallic sleeve and at least three of the conductive bar members surrounding the power-supply pin, an impedance matching can be attained by the metallic sleeve while the surface wave generation can be effectively restrained by means of the conductive bar members. Accordingly, there can be achieved remarkable improvements in the reflection power characteristics of FIG. 12, as will be clear when a dotted-line curve x representing the present invention is compared with a chain-line curve $x_1$ denoting an arrangement having neither of the metallic sleeve or the bar members, or with a solid-line curve $x_2$ denoting an arrangement in lack of the sleeve, and thus the antenna characteristics can be effectively improved according to the present invention.

Figure 13:
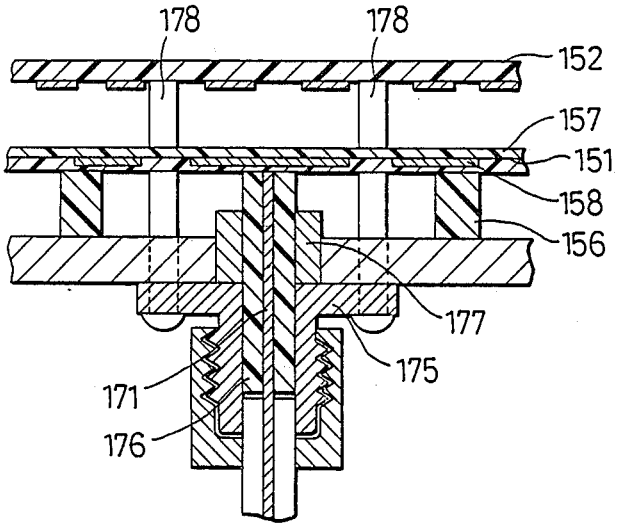
FIG. 13 is a fragmentary sectioned view of the power-supply means in another embodiment employable in the present invention.
Figure 15:
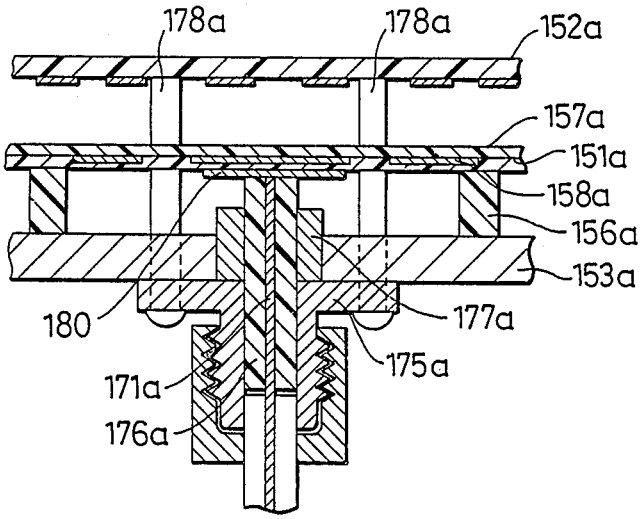
FIG. 15 is a fragmentary sectioned view of another terminal power supply means employable in the present invention.
Figure 14:
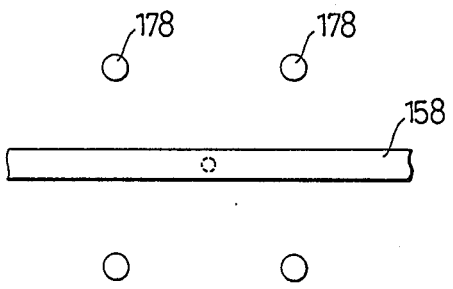
FIG. 14 is a plan view of the power supply means of FIG. 13.

According to still another feature of the present invention, there is no direct connection between the power-supply pin of the power-supply means and the power-supply circuit of the first antenna layer. Referring to FIGS. 13 and 14, substantially the same constituent members as those in the embodiments of FIGS. 5 and 6 are denoted by the reference numerals employed in the embodiment of FIG. 7 but added by 100. In the present invention, a power supply pin 171 is disposed just to be close to a sheet member 157 of a first antenna layer 151 provided on one side with a power-supply circuit 158, and conductive bar members 178 are also provided to surround the pin 171 in the same manner as in the embodiment of FIGS. 6 and 7, in which event the power-supply circuit 158 and pin 171 are not directly connected but are brought into a state in which they are electromagnetically coupled. In this arrangement, the transmission power which has reached the tip end of the pin 171 achieves the electromagnetic coupling thereof to the power-supply circuit 158 in combination with the action of the conductive bar members 178, and the power can be supplied to the circuit 158. Since in the present case the power-supply pin 171 is not connected to the circuit 158 by means of any soldering or the like, it becomes possible to employ such conductive material as aluminum which is hard to be connected by such soldering means or the like, for the circuit 158, and the arrangement is advantageous also in an event when the power-supply circuit 158 is intended to be covered with a synthetic resin layer, which layer being allowed to be provided without any trouble caused by the soldering or the like. As shown in FIG. 15, further, the electromagnetic coupling can be expected to be promoted when a flat conductive plate 180 is provided at the tip end of the power-supply pin 171*a* to be adjacent one surface of the first antenna layer 151*a* and to extend in a direction in which the power-supply circuit 158*a* extends. In FIG. 15, the same constituent members as in FIGS. 13 and 14 are denoted by the same reference numerals as those in the latter but as accompanied by suffix "a". In the present instance, further, the power-supply circuit and flat plate may be provided on the same side of the sheet member 157*a* of the first antenna layer, in which event a hot-melt film or adhesive agent is to be employed as the sheet metal so that the flat plate 180 can be easily bonded to the member simply by a depression.

Figure 16:
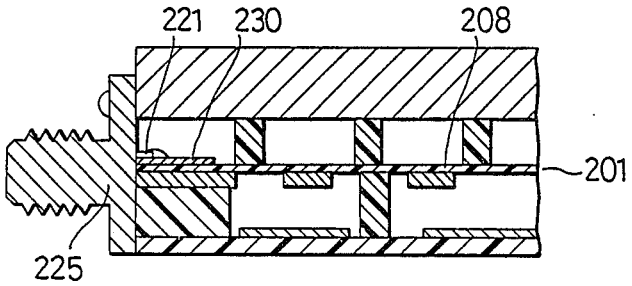
FIGS. 16 to 18 are fragmentary sectioned views of the terminal power-supply means in other working aspects of the present invention.

The electromagnetic coupling between the power-supply pin and the power-supply circuit. As shown in FIG. 16, a connector 225 havig a power-supply pin 221 may be secured to a peripheral end edge of the plane antenna to extend the pin along the plane of the circuit 208, while a flat conductive plate 230 is secured to the pin as disposed immediately on the first antenna layer 201. The flat plate 230 may be provided to be integral with the power-supply pin 221 when the pin is made flat and elongated.

Figure 17:
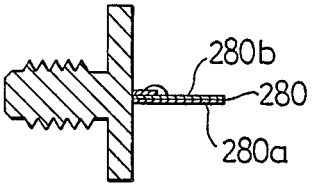
Figure 18:
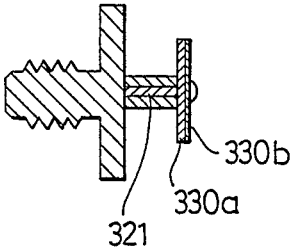

As shown in FIG. 17, further, the flat conductive plate 280 may be provided in the form of a conductor pattern 280*b* by means of the etching process on a plastic film 280*a* or, as required, it may be possible to employ, as shown in FIG. 18, a connector having a power-supply pin 321 to which a plastic film 330*a* carrying a conductor pattern 330*b* is secured at right angles.

In the present invention, further, a variety of design modifications can be made without altering the gist of the invention. For example, the first and second dielectric layers have been referred to as consisting of the foamed resin having at least in one of the layers the sequential cavities, but it may be possible to employ either one of combinations of solid dielectric layers both merely of the foamed resin having no cavity at all, of a solid dielectric layer of the foamed resin with a dielectric layer of the foamed resin with the sequential cavities, of two solid dielectric layers of the foamed resin, and of a solid dielectric layer of the foamed resin with an air layer as the other dielectric layer.

What we claim as our invention is:

1. A planar shaped antenna for receiving polarized waves transmitted on SHF band, comprising:

a ground conductor, a first antenna layer disposed above said ground conductor and including:

a first synthetic resin sheet member, a power-supply circuit of electrically conductive material disposed on said first sheet member, and a first dielectric layer formed of foamed resin and containing a plurality of cavities, said first dielectric layer disposed between said power-supply circuit and said ground conductor to space the former above the latter, and a second antenna layer disposed above said first antenna layer and including:

a second synthetic resin sheet member, a radiator circuit of electrically conductive material disposed on said second sheet member and electromagnetically coupled to said power-supply circuit, and a second dielectric layer formed of foamed resin containing a plurality of cavities, said second dielectric layer disposed between said second sheet member and said first antenna layer.

2. A planar shaped antenna according to claim 1, wherein said cavities in said first and second dielectric layers are square shaped to render the layer to be in a lattice formation as a whole.

3. A planar shaped antenna according to claim 2, wherein said cavities in each of said first and second dielectric layers occupy more than 4/9 of the surface area of the dielectric layer.

4. A planar shaped antenna according to claim 1, which further comprises a protective member fitted over said second antenna layer, said protective member being provided to form a covering lid of a casing for the antenna, said ground connector forming a part of said casing, and said first and second antenna layers being intimately accommodated within said casing.

5. A planar shaped antenna according to claim 4, which further comprises a holding means U-shaped in cross-section and fitted around said casing.

6. A planar-shaped antenna for receiving polarized waves transmitted on SHF band, comprising:

a ground conductor, a first antenna layer disposed above said ground conductor and including:

a first synthetic resin sheet member, a power-supply circuit of electrically conductive material disposed on one side of said first sheet member, a first dielectric layer disposed between said power-supply circuit and said ground conductor, and a second antenna layer disposed above said first antenna layer and including:

a second synthetic resin sheet member, a radiator circuit of electrically conductive material disposed on said second sheet member and electromagnetically coupled to said power-supply circuit, and a second dielectric layer disposed between said second sheet member and said first antenna layer, and a power-supply means for supplying electrical power to said power supply circuit and comprising:

a plurality of electrically conductive bar members each extending at least partially through both of said dielectric layers, said bar members being separated from one another to define a space therebetween, and a power-supply pin extending into said space and terminating close to another side of said first sheet member having said power supply circuit on said one side to establish electromagnetic connection therewith in cooperation with said bar members.

7. A planar shaped antenna according to claim 6, wherein said power-supply means further comprises a conductive member disposed between said power-supply pin and said conductive bar members for enclosing the power-supply pin.

8. A planar shaped antenna according to claim 7, wherein said power-supply pin is connected to a connector of a coaxial cable, said conductive bar members are secured at one end to said connector, and said conductive enclosing member is connected to said ground conductor.

9. A planar shaped antenna according to claim 7, wherein said conductive bar members are provided to be more than three, and a power-supply point of said power-supply pin to said power-supply circuit is disposed within a zone defined by lines respectively connecting respective adjacent ones of the conductive bar members.

10. A planar shaped antenna according to claim 9, wherein said conductive bar members are in the form of screws.

11. A planar shaped antenna according to claim 7, wherein said conductive enclosing member is a metallic sleeve.

12. A planar shaped antenna according to claim 7, wherein said power-supply means further comprises a flat conductive plate disposed along the plane of said power-supply circuit and secured to a terminal end of said power-supply pin.

* * * * *